US005326101A

United States Patent [19]

Fay

[11] Patent Number: 5,326,101

[45] Date of Patent: Jul. 5, 1994

[54] LAW ENFORCEMENT BATON WITH PROJECTABLE RESTRAINING NET

[76] Inventor: Larry R. Fay, 717 Lawrence St., Watertown, N.Y. 13601

[21] Appl. No.: 55,350

[22] Filed: May 3, 1993

[51] Int. Cl.[5] ..... F41B 15/02; F41F 1/00

[52] U.S. Cl. ..... 273/84 R; 43/59; 124/59; 124/1; 273/343; 273/129 AP

[58] Field of Search ..... 43/8, 58, 59, 60; 124/56, 59, 1; 273/317, 343, 405, 129 AP, 84 R, 84 ES; 42/1.16, 1.13, 90

[56] References Cited

U.S. PATENT DOCUMENTS 3,787,013 1/1974 McKenzie ..... 244/155 R
4,559,737 12/1985 Washington ..... 43/59

FOREIGN PATENT DOCUMENTS 1007949 10/1965 United Kingdom ..... 43/60

*Primary Examiner*—Vincent Millin
*Assistant Examiner*—William M. Pierce
*Attorney, Agent, or Firm*—Katherine McGuire

[57] ABSTRACT

A law enforcement baton for enhanced suspect control and apprehension comprises detachable, coextensive, proximal and distal lengths with a handle portion removably perpendicularly attached thereto with the handle portion and distal length being of identical construction and interchangeable upon the baton. The distal length includes a central bore with a plurality of reduced diameter bore holes extending parallel thereto in annularly spaced relation thereabout. A net having a plurality of elastic lines with retaining elements attached thereto is removably positioned within the central bore and the plurality of bore holes, respectively. The proximal length includes an opening wherein a compressed air canister is removably inserted with the sealed end thereof being in fluid communication with the bore openings in the distal length when the proximal and distal lengths are attached together. A sharp member located internally of the distal length is movable via a solenoid to break the seal of the canister upon pressing a button located on the outwardly facing surface of the distal length. When the seal is broken, compressed air creates a force against the net and flexible lines in the distal length thereby projecting the net and lines therefrom a distance sufficient to entrap an unwary criminal suspect. The net is directed at and impacts the upper torso region of the suspect with the elastic lines wrapping therearound with the retaining elements engaging the net thereby enveloping the suspect's arms to facilitate subsequent apprehension of the suspect.

19 Claims, 5 Drawing Sheets

LAW ENFORCEMENT BATON WITH PROJECTABLE RESTRAINING NET

BACKGROUND OF THE INVENTION

The present invention relates to police batons and, more particularly, to a police baton including a restraining net which is normally hidden within the forward end of the baton and which may be projected therefrom to entangle and restrain a criminal suspect when necessary.

An example of a device used to entangle and stop a fleeing suspect may be seen in U.S. Pat. No. 4,559,737 issued to Washington on Dec. 24, 1985. The Washington device is seen to resemble a rifle with diverging barrels at the distal end thereof and through which a pair of projectiles are propelled. The projectiles are connected to one another by a length of strong line which wraps around the legs of the suspect with the help of the projectiles thereby stopping the suspect in his tracks. While the Washington device may be effective at preventing a suspect from further flight, it fails to restrain the arms of the fugitive which would be helpful to the apprehending officer who is dealing with a hostile or resistant suspect. Furthermore, the Washington device cannot easily be carried by the officer and must be operated with both hands, one hand to pull the trigger and the other to hold and support the barrel.

SUMMARY OF THE INVENTION

It is therefore a principal object of the present invention to provide a suspect restraining device which is incorporated into a police baton of conventional size and configuration.

It is a further object to provide a suspect restraining device of the above type which is effective at substantially subduing a hostile suspect to the extent necessary to bring the suspect under control and into custody without fear of serious injury to the officer.

It is another object of the present invention to provide a suspect restraining device of the above type in which the restraining net portion thereof is hidden within the distal length of the baton and unnoticeable prior to release.

It is yet a further object of the present invention to provide a suspect restraining device of the above type which includes a back-up restraining net in a removable handle portion which is interchangeable with the distal length of the baton contacting the primary restraining net.

It is still another object of the present invention to provide a suspect restraining device of the above type which is simple and easy to operate.

Other objects will in part be obvious and in part appear hereinafter.

In accordance with the foregoing objects, the invention comprises a law enforcement device embodying the general size and configuration of a conventional police baton having a substantially cylindrical shaft portion and a shorter handle portion attached to and extending perpendicularly therefrom. The distal length of the shaft forwardly of the handle portion includes a central bore which is open at the distal end of the shaft and extends longitudinally within the shaft for the entire distal length thereof. A plurality of discrete bore holes are formed within the outer wall of the distal length and are annularly spaced about the central bore with each of the discrete bore holes also being open at the distal end of the shaft and extending longitudinally within the distal length. The central bore and the discrete bore holes communicate with each other at a common bore area located internally of and at the end of the distal length of the shaft opposite the distal end.

The distal length of the shaft which includes the central bore and plurality of discrete bore holes is removable from the remainder of the baton. The handle portion is also removable from the baton shaft and is of a structure identical to the removable distal length of the shaft described above such that the two are interchangeable upon the proximal length of the baton for reasons explained below.

The proximal length of the baton shaft also includes a central bore which is open and accessible when the proximal and distal lengths of the baton shaft are detached from one another. A retaining net is provided having a plurality of individual, flexible lines extending from the periphery of the net. Each line includes a plurality of flexible retaining elements attached to and spaced therealong with the net being removably inserted within the central bore of the distal length of the shaft and each one of the net lines being removably inserted within a respective one of the discrete bore holes surrounding the central bore. A pressurized air canister is deposited into the bore of the proximal length prior to attaching the proximal and distal lengths together. The open end of the canister which is of course sealed prior to use extends a slight distance within an opening in the distal length when the distal and proximal lengths are attached together, the sealed end being in direct communication with the common bore area of the distal length.

Means are provided in the distal length for selectively puncturing the sealed end of the canister which thus releases a stream of pressurized air into the common bore of the distal length. The pressurized air proceeds to enter each of the bore holes containing the peripheral lines having the retaining elements and also the central bore containing the net, all of which are thereby forcibly projected from the open, distal end of the distal length. The baton is aimed at a suspect and fired as described above with the result being that the net surrounds the upper body of the suspect with the lines and retaining elements wrapping themselves around the suspect's body. The retaining elements, while not sharp enough to pierce the skin or do other bodily injury, grasp the net such that the suspect is temporarily bound to the extent that the officer may make a relatively easy arrest.

DETAILED DESCRIPTION

Figure 1:
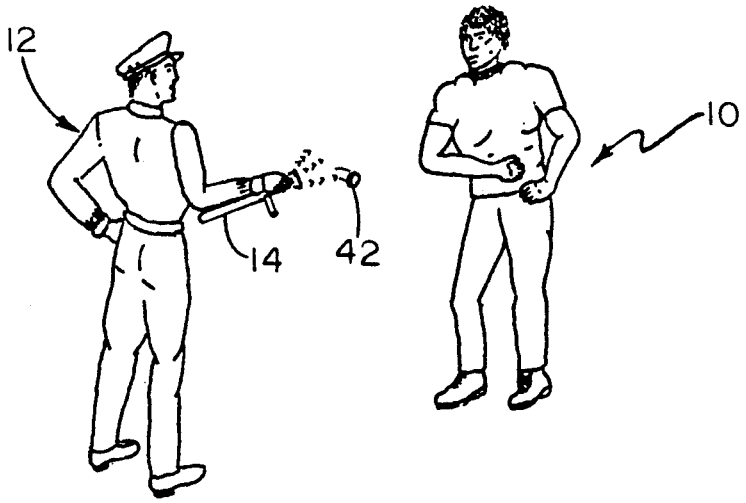
FIG. 1 is a perspective view of a criminal suspect confronting a law enforcement officer who is holding the inventive baton in the intended manner in preparation of firing the device at the suspect.
Figure 2:
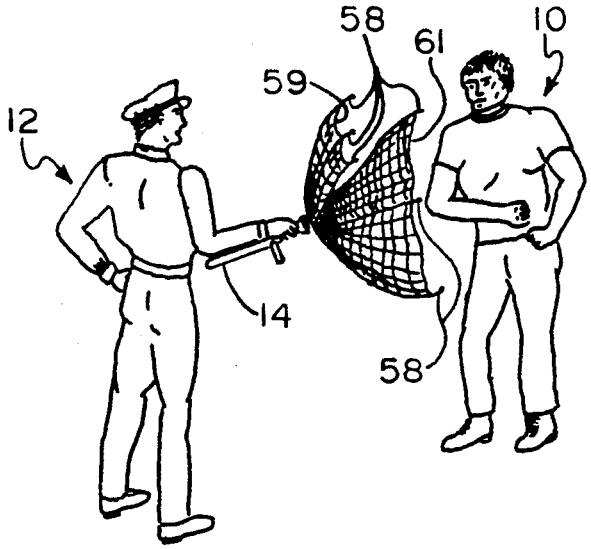
FIG. 2 is the view of FIG. 1 showing the net being fired from the distal end of the baton.
Figure 3:
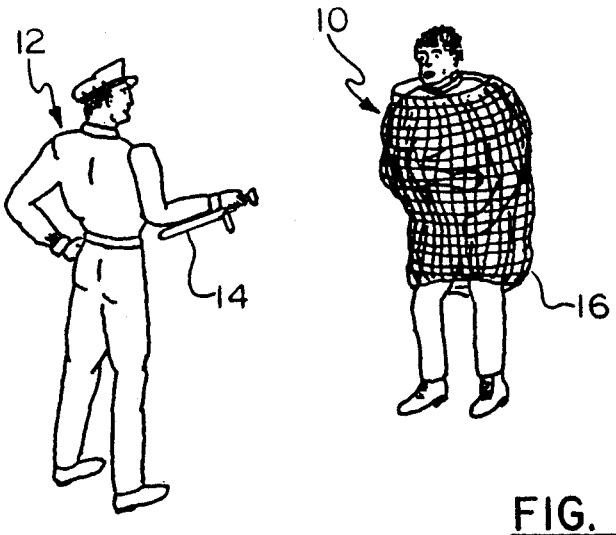
FIG. 3 is the view of FIGS. 1 and 2 showing the net having wrapped itself about the upper body of the suspect following firing thereof from the baton in the intended manner.

Referring now to the drawings, there is seen in FIGS. 1-3 a criminal suspect 10 confronting a law enforcement officer 12 who is holding the inventive law enforcement baton 14 in his right hand. Baton 14 is operable to selectively fire and project a net 16 therefrom which wraps itself about the upper body of suspect 10 in the manner to be described. With the arms of the suspect 10 thus restrained from movement by net 16, subsequent apprehension of suspect 10 by officer 12 is facilitated.

Figure 4:
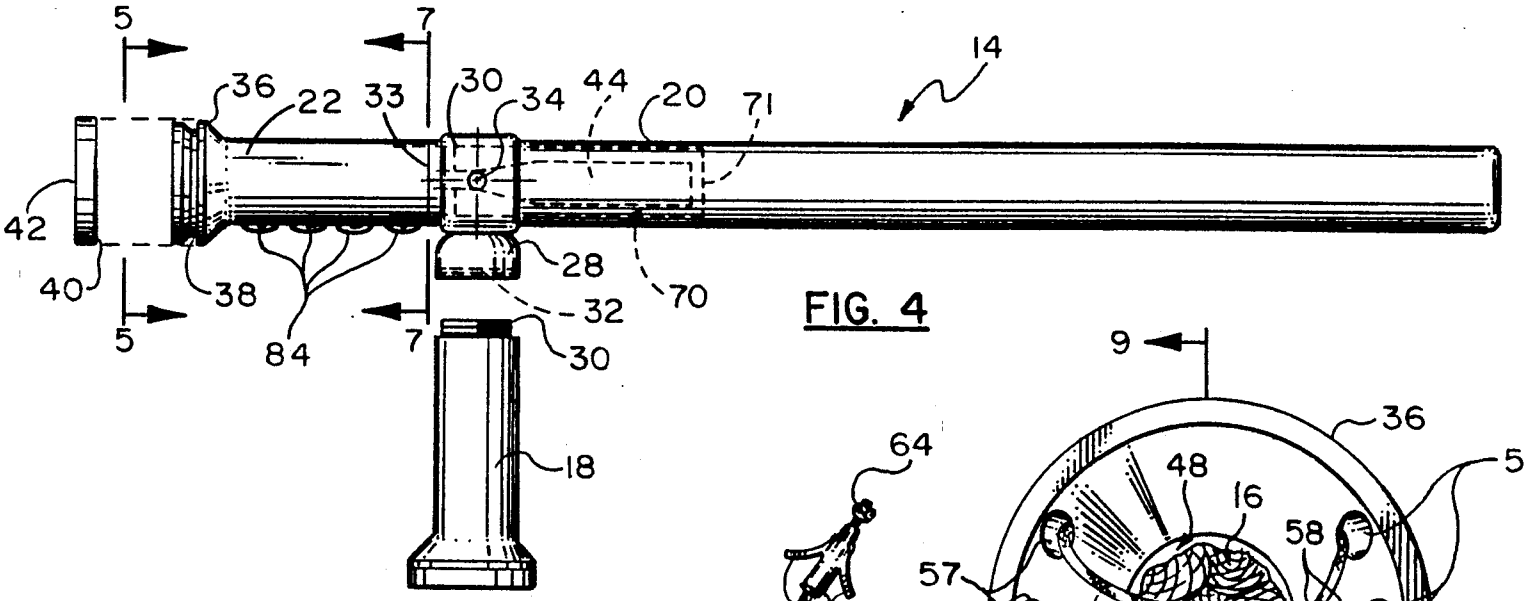
FIG. 4 is a side, elevational view of the baton with the handle portion and end cap being shown in spaced relation thereto.

Referring now to FIG. 4, baton 14 is seen to comprise a substantially cylindrical, elongated shaft having a removable handle portion 18 which extends perpendicularly from the main shaft when attached thereto. The main shaft of baton 14 is separated into proximal and distal lengths 20 and 22, respectively, which removably threadedly attach to each other as seen best in FIGS. 6 and 9 which show external threads 24 on distal length 22 engaging internal threads 26 on proximal length 20 such that the outer surfaces of each are substantially flush when lengths 20 and 22 are attached together.

Handle 18 and distal length 22 are identical in structure and are interchangeable upon proximal length 20. External threads 30 on handle 18 removably engage internal threads 32 formed in hollow, dome-shaped fitting 28 which itself attaches to baton 14 by circular collar 30 attached thereto and which is positioned in encircling relation around baton 14 adjacent the juncture line 33 of proximal and distal lengths 20 and 22. Collar 30 is secured to proximal length 20 by a screw 34 with collar 30 and handle 18 not being shown in FIGS. 6 and 9. Since handle 18 and distal length 22 are of identical structure, detailed description thereof will be directed solely to distal length 22 hereinafter.

Referring still to FIG. 4, and also to FIGS. 5, 6, 7 and 9, distal length 22 is seen to taper outwardly at the end thereof opposite the end attached to proximal length 20. Tapered end 36 includes a peripheral, annular groove 38 in which the lip 40 of a rubber end cap 42 removably and frictionally engages for purposes hereafter explained. Briefly, distal length 22 is configured to accept and hold retaining net 16 therein until fired therefrom by a blast of compressed air released from an air cartridge 44 held within proximal length 20 by pressing button 46 located on the external surface of tapered end 36.

Figure 6:
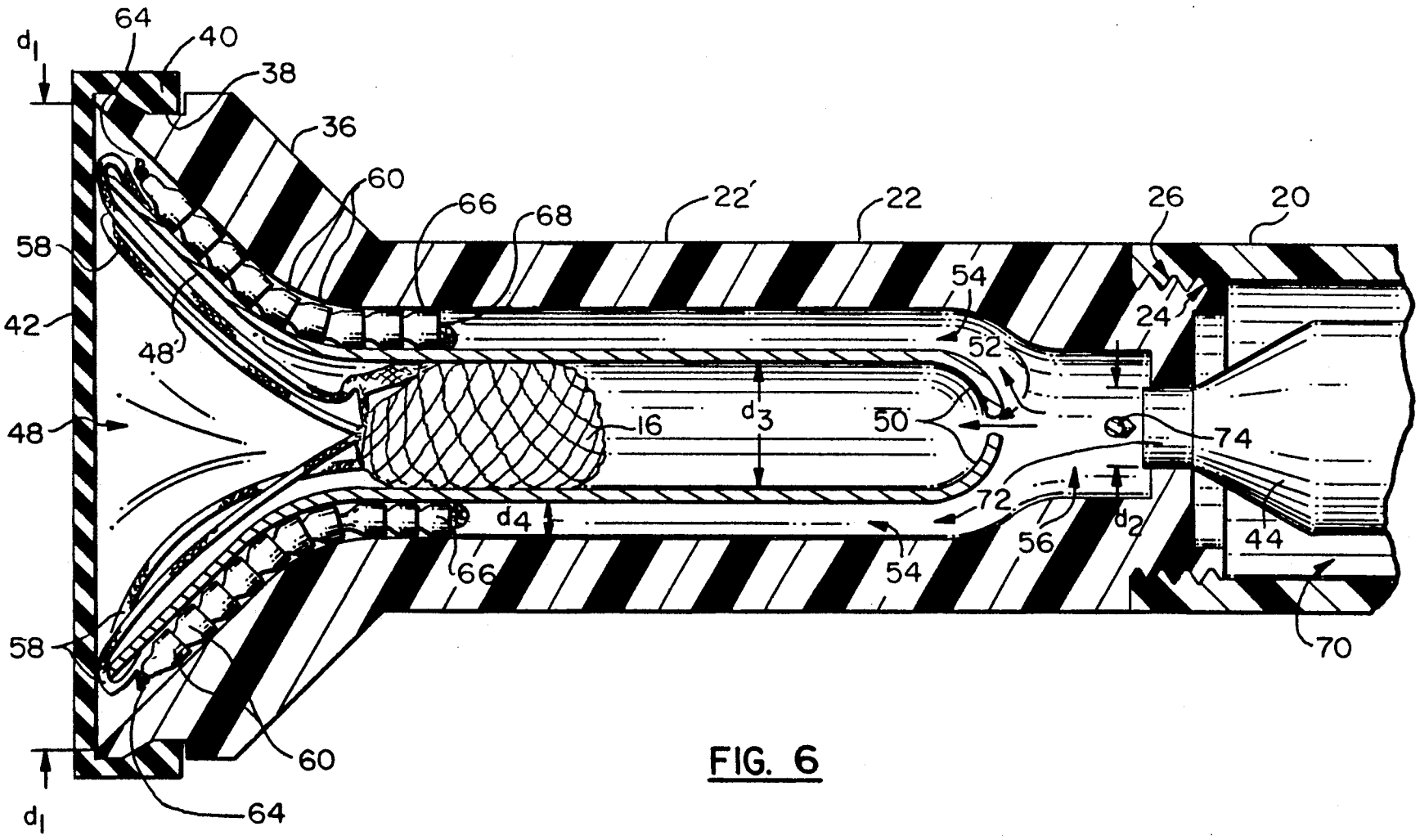
FIG. 6 is a longitudinal, cross-sectional view of the distal length and part of the proximal length of the baton as taken through the line 6—6 in FIG. 5.
Figure 9:
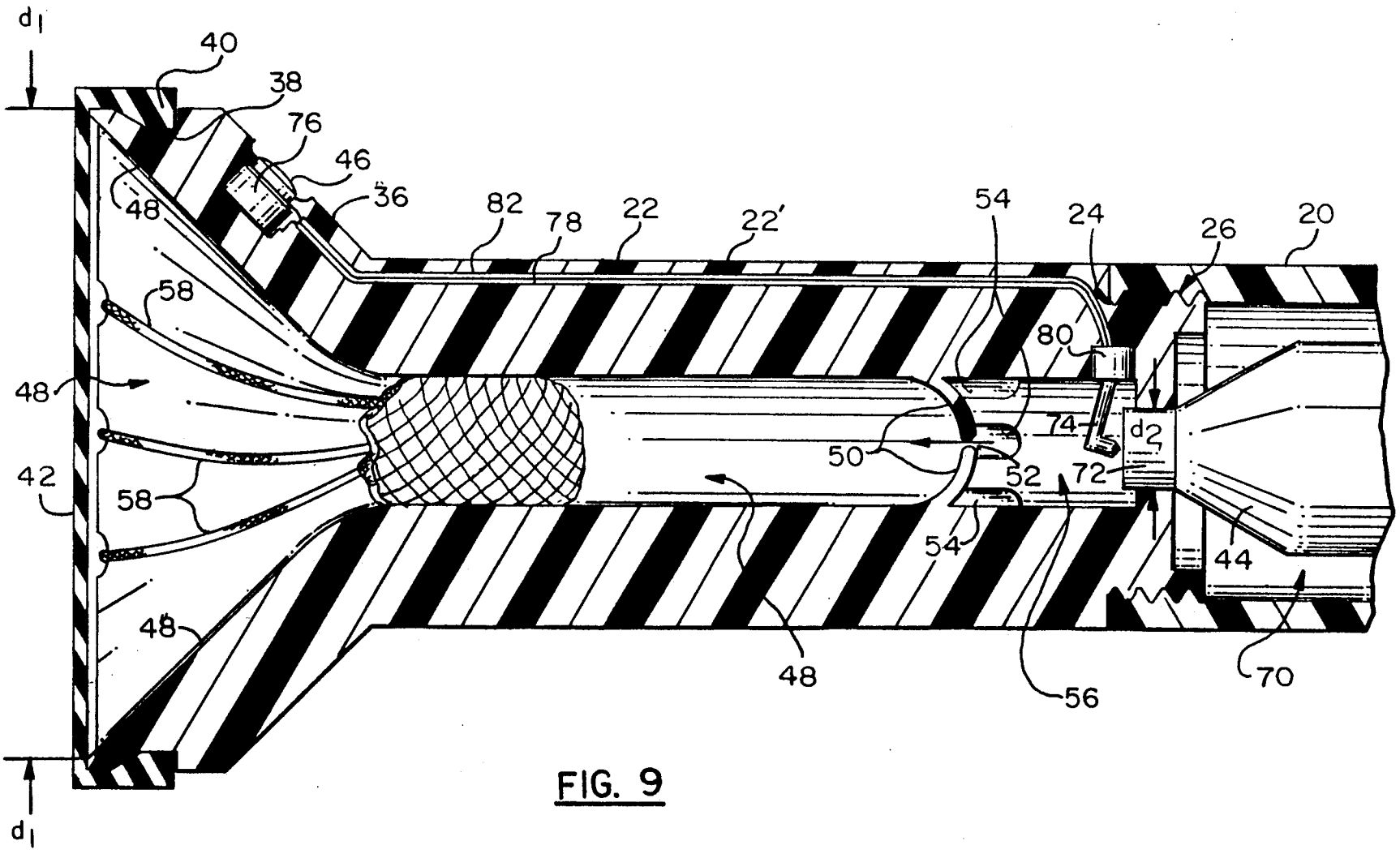
FIG. 9 is a longitudinal, cross-sectional view of the distal length and a portion of the proximal length of the baton as taken along the line 9—9 in FIG. 5.

More specifically, distal length 22 includes a central, axial bore 48 which extends and tapers from a large diameter $d_1$ at tapered end 36 to a small diameter $d_2$ at the opposite end thereof (FIGS. 6 and 9). The inside surface 48' of central bore 48 includes an integral, inwardly extending, circular flange 50 located approximately $\frac{3}{4}$ of the length of distal length 22 from tapered end 36. A circular aperture 52 is formed in flange 50 wherethrough compressed air released from cartridge 44 may pass in accordance with the directional arrow.

Figure 5:
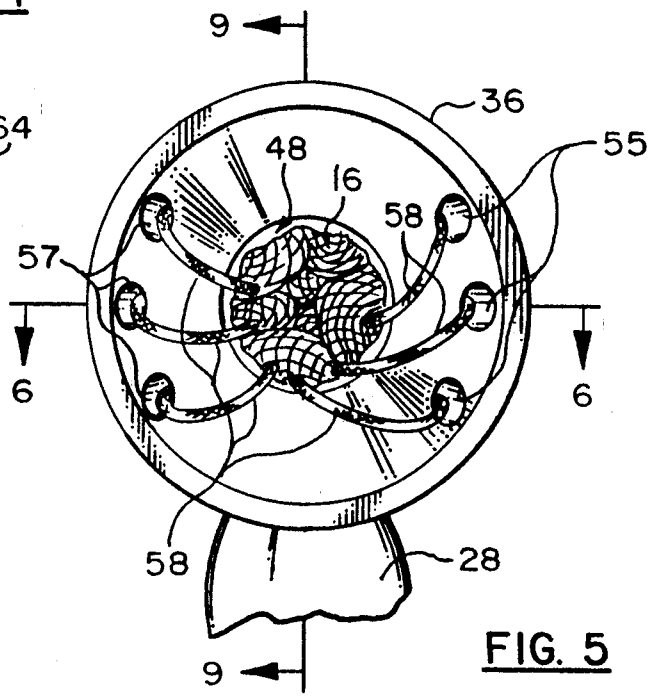
FIG. 5 is a plan view of the distal end of the baton as seen along the line 5—5 in FIG. 4.
Figure 7:
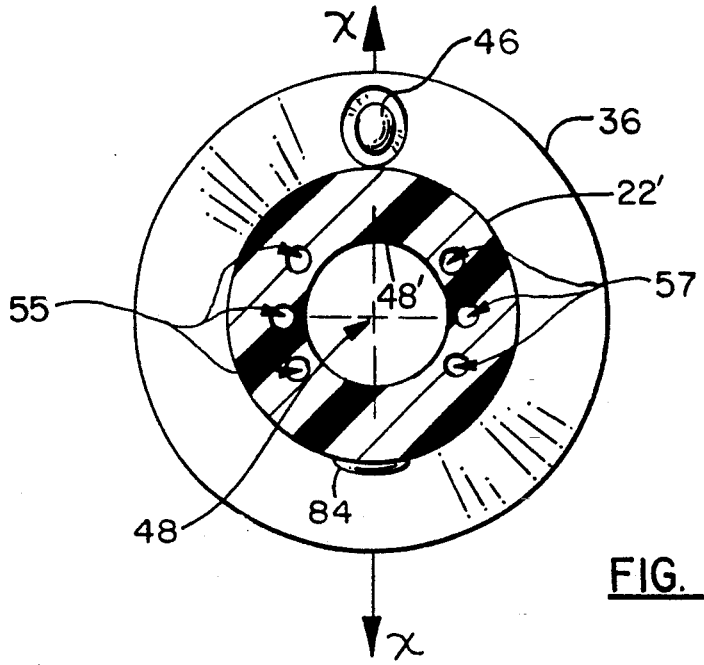
FIG. 7 is a lateral, cross-sectional view of the distal length of the baton as taken along the line 7—7 in FIG. 4.
Figure 8:
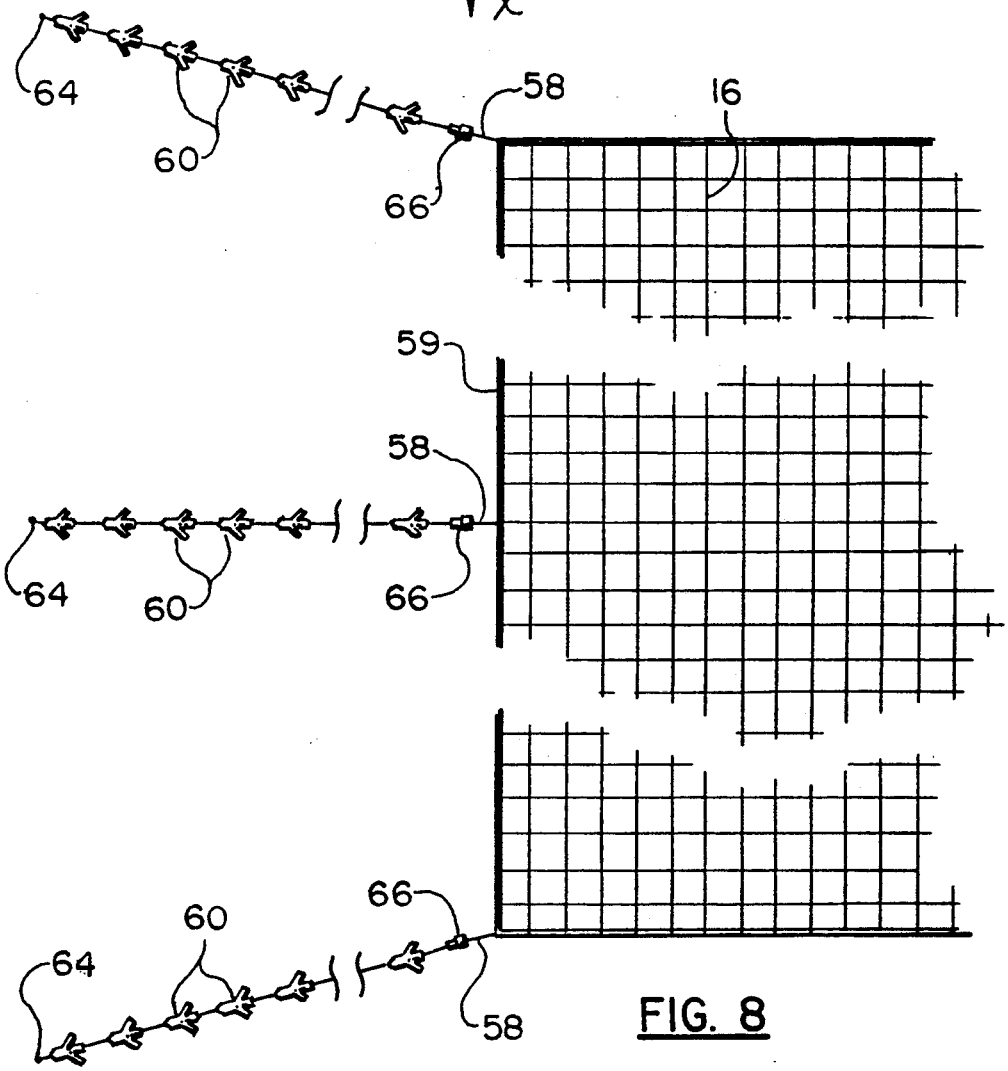
FIG. 8 is a plan view of the net and three of the peripheral lines shown in their fully extended positions with portions thereof broken away.

A plurality of annularly spaced, longitudinally extending bore holes 54 of substantially smaller diameter $d_4$ than the middle diameter $d_3$ of central bore 48 extend within the wall of distal length 22 between the inside and outside surfaces 48' and 22' thereof, respectively. In the preferred embodiment, two sets 55 and 57 of three bore holes 54 each are positioned on opposite sides of central bore 48, as seen in FIGS. 5 and 7. Each of the plurality of bore holes 54 extend from tapered end 36 (FIG. 5) to the opposite end of distal length 22 to communicate with central bore 48 in the common bore area 56 located between flange 50 and the portion of central bore 48 having diameter $d_2$.

Figure 10:
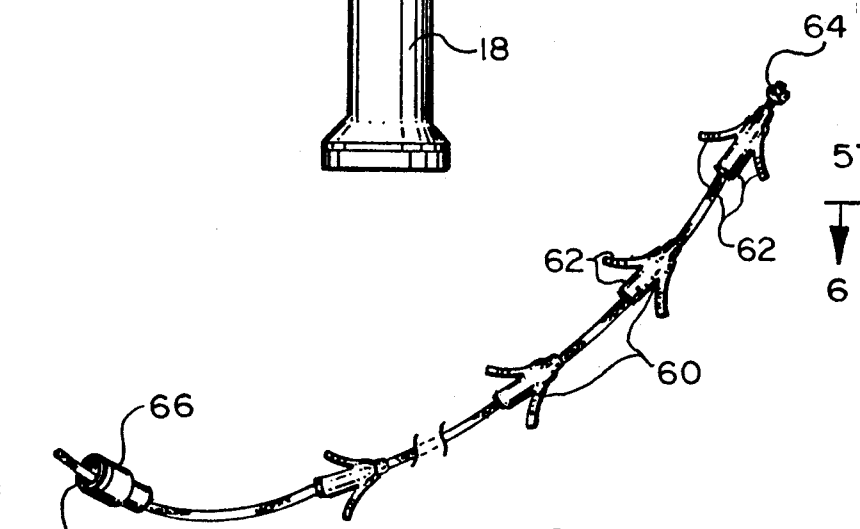
FIG. 10 is an enlarged, perspective view of a portion of one of the peripheral lines with retaining elements attached thereto.

Attention is turned to FIGS. 2, 5, 6 and 8 which show net 16 to be of generally rectangular outline having a plurality of elastic lines 58 attached thereto in equally spaced relation along opposite side edges 59 and 61 thereof. Each line 58 includes a plurality of resilient retaining elements 60 attached thereto in longitudinally spaced relation therealong. As seen best in FIG. 10, retaining elements 60 each have an annular array of multiple prongs 62 which are normally flared outwardly. Although not sharp enough to pierce skin, prongs 62 are pointed enough to grasp and become engaged with net 16 when moved thereagainst in a direction away from knotted end 64 as would occur upon net 16 enveloping a body against which it is directed by pressing button 46 and firing canister 44 as seen in FIGS. 2 and 3.

Each line 58 is inserted within a respective bore hole 54 as seen best in FIGS. 5 and 6 with net 16 deposited inside central bore 48 and portions of lines 58 extending therebetween at the opening of distal end 36 (FIG. 5). As seen in FIG. 6, prongs 62 are compressed together with each retaining element 60 placed in longitudinally consecutive, contacting arrangement within bore hole 54. Knotted end 64 is placed at the opening of distal end 36 and a cup shaped element 66 which is also attached to line 58 is positioned inside bore hole 54 to receive the blast of air from canister 44 (retaining elements 60 are located between knotted end 64 and cup shaped element 66). The open end 68 of cup shaped element 66 is oriented toward canister 44 within bore hole 54 to permit a maximum amount of force thereagainst by the compressed air released from canister 44.

With proximal and distal lengths 20 and 22 separated, capped end 72 of canister 44 is inserted in reduced diameter ($d_2$) opening 70 of distal length 22, the relative dimensions being such that end 72 is in essentially frictionally sealed engagement with opening 70. Distal length 22 is then attached to proximal length 20 by engaging internal threads 26 on proximal length 20 with external threads 24 on distal length 22 as seen in FIGS. 6 and 9. When threads 24 and 26 are fully engaged, canister 44 extends into and abuts against end 71 of hollow recess 70 in proximal length 20, as seen in FIG. 4. In this position, a pointed, L-shaped arm 74 lies immediately adjacent the top of capped end 72 and is moveable in a direction toward canister 44 to pierce capped end 72 thereof upon pressing button 46 on distal end 36 of distal length 22. A low voltage, circular battery 76 is located immediately below button 46 which itself is removable to access battery 76 for replacement when needed. Pressing button 46 completes an electric circuit with battery 76, wires 78 and a solenoid 80 to which arm 74 is pivotally attached. As seen in FIG. 9, wires 78 extend from battery 76 to solenoid 80 through a longitudinally extending passageway 82 formed in distal length 22 closely adjacent outer surface 22' thereof.

Thus, upon pressing button 46, solenoid 80 is electrically activated to move arm 74 towards canister 44 and puncture capped end 72 thereof. Compressed air contained in canister 44 is thereby released through end 72 and is directed into common bore area 56 of distal length 22. Air flow proceeds through aperture 52 in circular flange 50 and into central bore 48 to net 16 located therein. Air simultaneously flows through each of the bore holes 54 to reach cup-shaped elements 66 in accordance with the directional arrows of FIG. 6. The force of the air against the cup-shaped elements 68 is sufficient to expel each line from 58 from its respective bore hole 54 and, likewise, to expel net 16 from central bore hole 48. The force is further sufficient to propel net 16 including lines 58 a distance of several feet from baton 14. As seen in FIG. 2, it is desirable to project net 16 toward a suspect 10 with opposite side edges 59 and 61 thereof oriented along either side of suspect 10.

In this regard, attention is turned to FIGS. 4 and 7 which show a plurality of longitudinally spaced, raised bumps 84 formed along the side of distal length 22 where handle 18 attaches, opposite button 46. As seen in FIG. 7, sets 55 and 57 of bore holes 54 are aligned along either side of axis X—X which extends from button 46 to bumps 84 through the center of distal length 22. Bumps 84 are intended to act as a manually sensitive, directional indicator to an officer 12 for correct orientation of baton 14 when firing net 16 therefrom. As aforementioned, it is desirable to project net 16 from distal length 22 with opposite side edges 59 and 61 thereof which have lines 58 attached thereto extending along either side of a suspect 10. When fired from distal length 22, net 16 expands with the retaining elements 58 projecting outwardly therefrom due to the outward taper of distal end 36 and bore holes 56 as lines 58 exit therefrom. With officer 12 manually grasping distal length 22, he positions bumps 84 to face downwardly and button 46 upwardly which he may then press with his thumb. Immediately prior to pressing button 46, however, rubber end cap 42 is removed from distal end 36 by simple manual removal thereof (e.g., prying it off with a thumb). With button 46 facing upwardly and bumps 84 facing downwardly, sets 55 and 57 of bore holes 56 are oriented to project respective pairs of lines 58 along either side of suspect 10 with a spread sufficient to also envelop the suspect's arms. Once net 16 hits suspect 10, lines 58 wrap around him with the lines 58 along one of the two opposite side edges 59 and 61 of net 16 extending across net 16 adjacent the opposite one of the two opposite side edges 59 and 61. Since lines 58 are elastic, the weight of retaining elements 60 stretch lines 58 as they extend outwardly and then around suspect 10. Upon retraction of lines 58, the prongs 62 of retaining elements 60 engage net 16 thereby effectively binding net 16 about the suspect's upper torso including his arms. With the suspect 10 thus restrained, apprehension is facilitated with the chance of the suspect 10 inflicting injury to the officer 12 being greatly diminished (FIG. 3).

Canister 44 is a single use source of compressed air which is to be discarded and replaced following firing thereof by pointed arm 74 piercing capped end 72 via button 46. This is easily accomplished by unscrewing distal length 22 from proximal length 20 which provides access to recess 70 in proximal length 20. Furthermore, handle 18 which, as aforementioned, is identical in structure to distal length 22 and interchangeable upon proximal length 20. It is intended that both distal length 22 and handle 18 be loaded with a net 16 including lines 58 in the manner described prior to a law enforcement 12 using the device. Once net 16 has been fired from distal length 22, it is removed from proximal length 20 and handle 18 is unscrewed from fitting 28 and attached to proximal length 20. (Canister 44 is removed and replaced upon removing distal length 22 from proximal length 20). Distal length 22 may then be attached to fitting 28 thus now becoming the handle portion of baton 14. Following a second firing of the net 16 contained in handle 18, both distal length 22 and handle 18 must be re-loaded with new nets 16 in the manner described.

The invention has been shown and described with regard to a preferred embodiment thereof. It is understood that changes may be made thereto without departing from the full spirit and scope of the invention as defined by the claims which follow. For example, other known sources of forced air flow may be substituted for canister 44 such as the type used to inflate automobile collision air bags, which technology uses a combustion of a sodium azide/ion oxide gas generant to produce nitrogen at a substantial rate to quickly fill the bag.

What is claimed is:

1. A law enforcement baton comprising:

a) a rigid, elongated shaft having coextensive, proximal and distal lengths, said distal length having a first, central, longitudinally extending bore extending inwardly from a first opening at the distal end of said distal length opposite said proximal length;

b) a net removably positioned within said first bore, said net having a predetermined perimeter;

c) means positioned in said proximal length selectively actuable to apply a force internally of said baton against said net, said force being directed into said first bore in a direction toward said first opening, said force being of a magnitude sufficient to expel said net from said first bore through said first opening and to propel said net outwardly from said distal length;

d) a first plurality of bore holes longitudinally extending within said distal length from a respective first plurality of openings at said distal end, inwardly towards said proximal length, said first plurality of bore holes extending in parallel, annularly spaced relation about said first, central bore;

e) a first plurality of flexible lines attached at first ends thereof about said perimeter of said net and extending therefrom terminating in free, second ends thereof; and f) a first plurality of retaining elements each configured to removably engage a portion of, and become entangled with, said net when moved thereagainst in a predetermined direction, said retaining elements being attached to said lines in longitudinally spaced relation therealong, each of said first plurality of lines including said first plurality of retaining elements being removably positioned within a respective one of said first plurality of bore holes with portions of said lines between said first and second ends thereof extending between said first opening and said first plurality of openings.

2. The invention according to claim 1 wherein said force is further applied against said first plurality of flexible lines, said force being directed into said first plurality of bore holes in a direction toward said first opening, said force being of a magnitude sufficient to expel said first plurality of flexible lines from said first plurality of bore holes through said first plurality of openings, respectively, and to propel said first plurality of flexible lines from said distal length.

3. The invention according to claim 2 and further including means detachably connecting said distal and proximal lengths together at respective, adjoining ends thereof.

4. The invention according to claim 3 wherein said proximal length includes a second opening extending inwardly toward said first opening from said adjoining end thereof.

5. The invention according to claim 4 wherein said means to apply said force against said net comprises a canister filled with compressed gas removably inserted within said second opening, said canister including a sealed end which is in fluid communication with said first bore upon attaching said proximal and distal lengths together and opening said sealed end, and wherein said means to apply said force to said net further comprises means operable to open said sealed end upon said selective actuation thereof.

6. The invention according to claim 5 wherein said means to open said sealed end comprises:

a) a member having a pointed end positioned adjacent said sealed end;

b) a solenoid positioned internally of said distal length and to which said pointed member is attached and movable thereby in a direction to pierce said sealed end; and c) means providing selective electric actuation of said solenoid.

7. The invention according to claim 6 wherein said means providing selective actuation of said solenoid comprises an electric switch mounted to an outwardly facing surface of said distal length, and a battery connected in series with said solenoid and said switch.

8. The invention according to claim 1 wherein said distal end of said distal length tapers outwardly.

9. The invention according to claim 1 wherein each of said proximal and distal lengths is of substantially cylindrical configuration.

10. The invention according to claim 9 and further comprising an annular and radially extending flange attached to and inside said central bore, said flange including a centrally located, circular aperture concentric with said central bore and wherethrough said force against said net is directed.

11. The invention according to claim 1 wherein said baton further comprises a handle portion including means removably attaching said handle portion to said baton in perpendicular relationship to said proximal and distal lengths.

12. The invention according to claim 11 wherein said handle portion and said distal length are of substantially identical construction with said handle portion including a second, central, longitudinal bore and a second plurality of bore holes longitudinally extending therein in parallel, annularly spaced relation about said second bore, said handle portion and said distal length being interchangeable with each other upon said baton.

13. The invention according to claim 12 wherein said means for removably attaching said handle portion to said baton comprises a collar with a fitting including a threaded opening attached thereto, said collar being attached in encircling relation about said baton adjacent said adjoining ends of said proximal and distal lengths with said threaded opening facing in a direction away from said baton, said handle portion further including a threaded end portion for threadedly engaging said threaded opening.

14. The invention according to claim 13 and further comprising a second net having a predetermined perimeter with a second plurality of flexible lines attached in spaced relation about said perimeter thereof, each of said lines including a plurality of retaining elements attached to said lines in longitudinally spaced relation therealong, said second net and said second plurality of lines being removably positioned within said second bore and said second plurality of bore holes respectively.

15. The invention according to claim 14 and further comprising first and second end caps removably attached in covering relation to said distal end of said distal length and the end of said handle portion opposite said threaded end, respectively.

16. The invention according to claim 1 wherein said first plurality of retaining elements each include a plurality of outwardly flared, annularly spaced, resilient hook elements.

17. The invention according to claim 16 and further comprising a hollow, cup-shaped element attached to each of said first plurality of flexible lines between said net and said first plurality of retaining elements.

18. The invention according to claim 1 wherein said first plurality of bore holes are of an even number with half of said first plurality of bore holes being located on one side of said first bore and the other half of said first plurality of bore holes being located on the opposite of said one side of said first bore.

19. The invention according to claim 18 wherein said distal length includes a plurality of longitudinally spaced, raised protrusions on the outer surface thereof extending from said distal end towards said proximal length in a location substantially midway between said one side and said opposite side of said first bore.

* * * * *